US008902029B2

(12) United States Patent
Kobayashi et al.

(10) Patent No.: US 8,902,029 B2
(45) Date of Patent: Dec. 2, 2014

(54) ELECTROMAGNETIC RELAY

(71) Applicant: Fujitsu Component Limited, Tokyo (JP)

(72) Inventors: Koyuru Kobayashi, Tokyo (JP); Satoshi Takano, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 14/067,571

(22) Filed: Oct. 30, 2013

(65) Prior Publication Data

US 2014/0145802 A1 May 29, 2014

(30) Foreign Application Priority Data

Nov. 29, 2012 (JP) ..... 2012-261398

(51) Int. Cl.
*H01F 7/10* (2006.01)
*H01H 50/46* (2006.01)

(52) U.S. Cl.
CPC ..... *H01H 50/46* (2013.01)
USPC ..... 335/245

(58) Field of Classification Search
USPC ..... 335/245
See application file for complete search history.

(56) References Cited

U.S. PATENT DOCUMENTS 3,201,660 A 8/1965 Stewart, Jr.

FOREIGN PATENT DOCUMENTS

| | | | |
|---|---|---|---|
| DE | 8804382 | | 4/1989 |
| EP | 1478002 | A2 | 11/2004 |
| JP | 59-149009 | | 8/1984 |
| JP | 62-114411 | | 7/1987 |
| JP | 1-283904 | | 11/1989 |
| JP | 6-53027 | | 2/1994 |
| JP | 2008-171639 | | 7/2008 |
| WO | WO 2006/100224 | A1 | 9/2006 |

OTHER PUBLICATIONS

Patent Abstracts of Japan, Publication No. 1-283904, Published Nov. 15, 1989.
Patent Abstracts of Japan, Publication No. 6-53027, Published Feb. 25, 1994.
Patent Abstracts of Japan, Publication No. 2008-171639, Published Jul. 24, 2008.
European Extended Search Report mailed Apr. 8, 2014 in corresponding European Patent Application No. 13192218.9.
Espacenet English Abstract of Japanese Publication No. 59-149009, Published Aug. 25, 1984.

*Primary Examiner* — Ramon Barrera
(74) *Attorney, Agent, or Firm* — Staas & Halsey LLP

(57) ABSTRACT

An electromagnetic relay includes: an iron core that has an end face and a groove which goes across the end face; and a shading coil that is fitted in the groove; wherein the shading coil is fixed to the iron core by applying caulking processing to a plurality of areas in the end face which sandwich the groove.

4 Claims, 11 Drawing Sheets

ELECTROMAGNETIC RELAY

CROSS-REFERENCE TO RELATED APPLICATIONS

This application is based upon and claims the benefit of priority of the prior Japanese Patent Application No. 2012-261398 filed on Nov. 29, 2012, the entire contents of which are incorporated herein by reference.

FIELD

A certain aspect of the embodiments is related to an electromagnetic relay.

BACKGROUND

There is an alternating-current electromagnetic relay which applies an alternating voltage to a coil as an electromagnetic relay that drives a switch with an electromagnet. In order to keep an attractive force of the electromagnet constant and to restrain a beat, a shading coil is attached to an iron core. Since the beat is restrained with the shading coil, the rectification of the alternating voltage is unnecessary. Japanese Laid-open Patent Publication No. 2008-171639 discloses a technique using a permanent magnet and an auxiliary yoke as a member which assists the attractive force. Japanese Laid-open Patent Publication No. 6-53027 discloses a technique which attaches the shading coil to the iron core with a screw mechanism. Japanese Laid-open Patent Publication No. 1-283904 discloses a technique which presses the shading coil toward the iron core and fixes the shading coil. Japanese Unexamined Utility Model Publication No. 62-114411 discloses a technique which fixes the shading coil by applying caulking processing to a pole face of the iron core.

SUMMARY

According to an aspect of the present invention, there is provided an electromagnetic relay including: an iron core that has an end face and a groove which goes across the end face; and a shading coil that is fitted in the groove; wherein the shading coil is fixed to the iron core by applying caulking processing to a plurality of areas in the end face which sandwich the groove.

The object and advantages of the invention will be realized and attained by the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Figure 1:
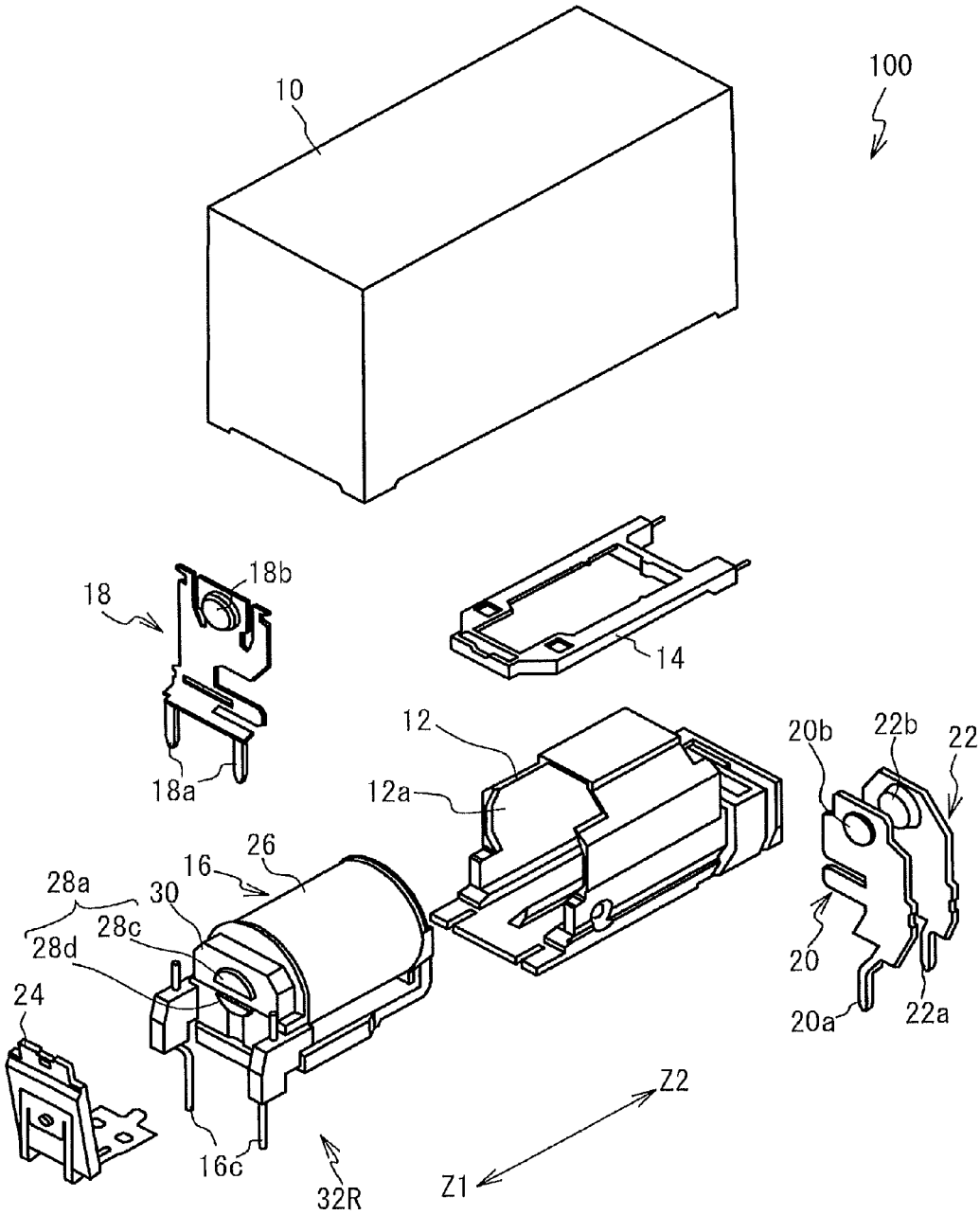
FIG. 1 is an exploded perspective view illustrating an electromagnetic relay.
Figure 2A:
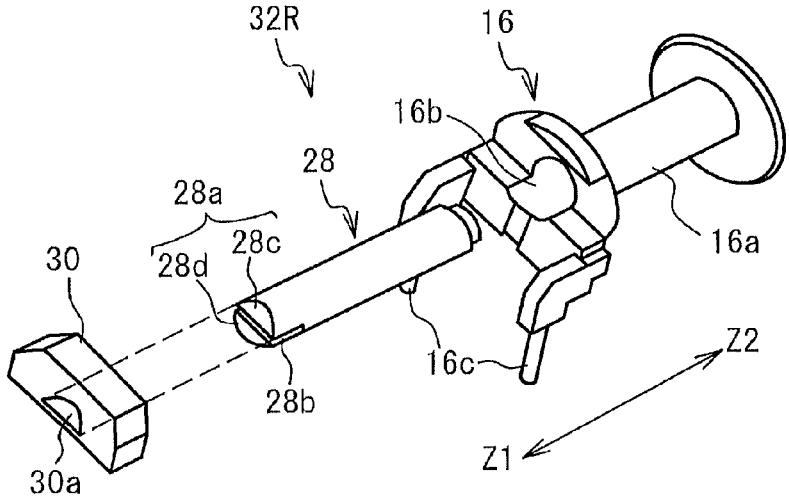
FIG. 2A is an exploded perspective view illustrating an electromagnet.
Figure 2B:
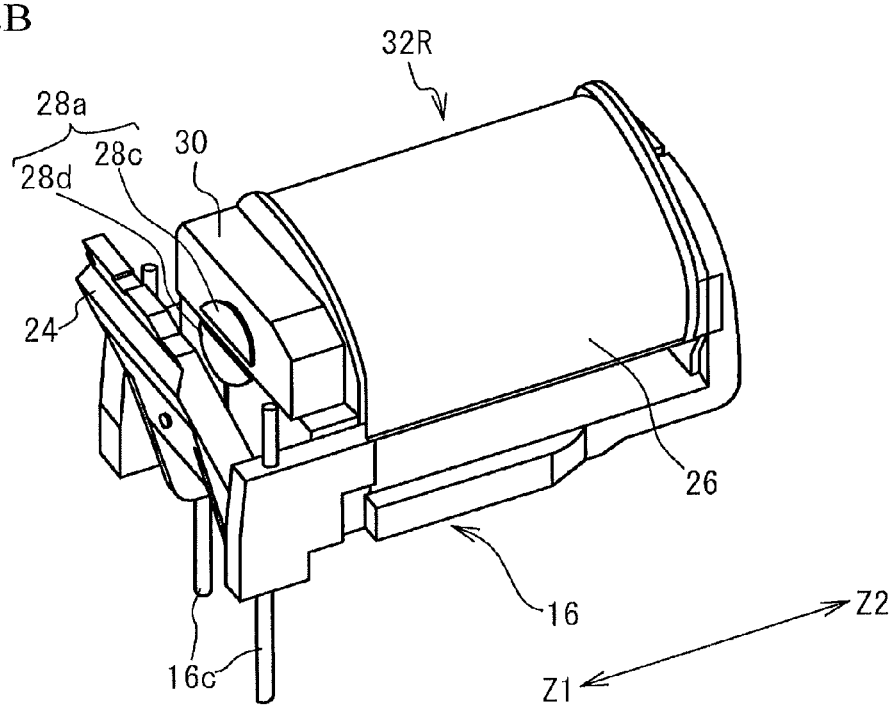
FIG. 2B is a perspective view illustrating the composition in which a bobbin, an armature, and the electromagnet are assembled.
Figure 3A:
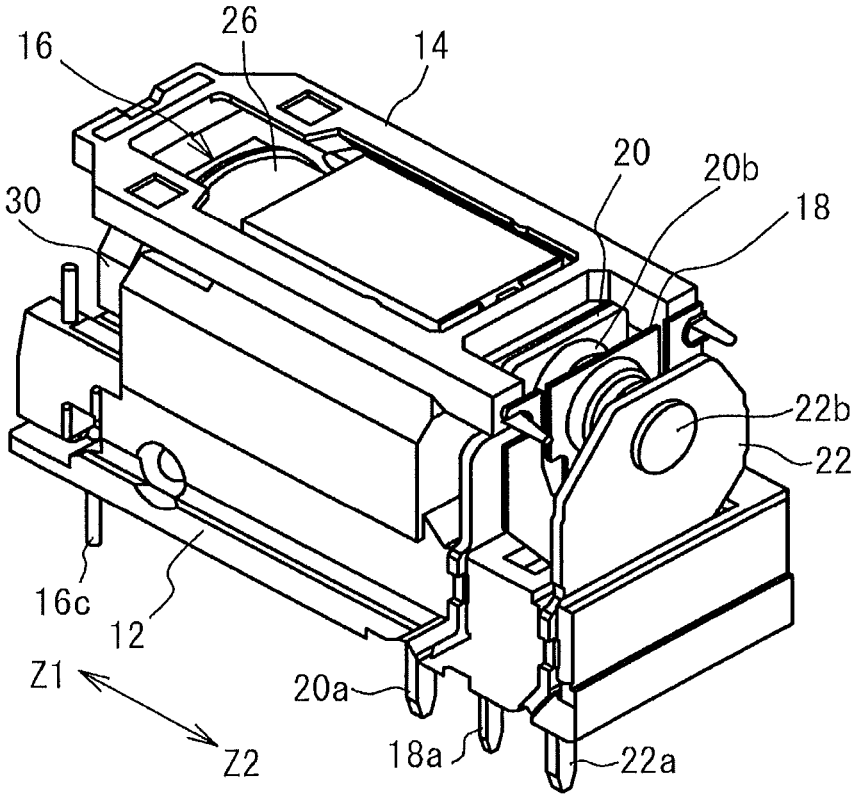
FIG. 3A is a perspective view illustrating the composition in which a card, the bobbin, the armature, the electromagnet and a contact member are assembled.
Figure 3B:
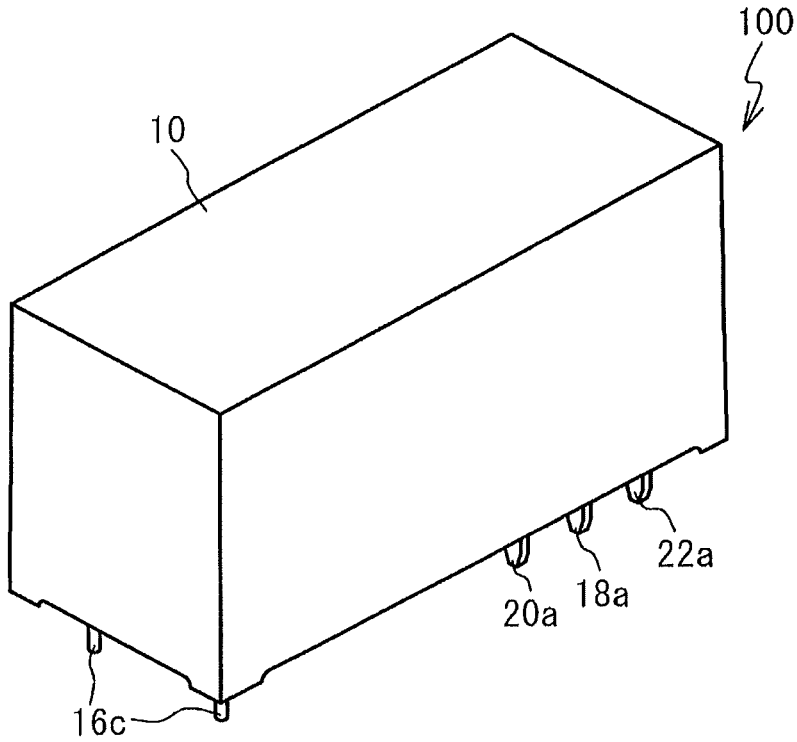
FIG. 3B is a perspective view illustrating an electromagnetic relay.

A description will now be given of the composition of an electromagnetic relay. FIG. 1 is an exploded perspective view illustrating an electromagnetic relay 100, FIG. 2A is an exploded perspective view illustrating an electromagnet 32R, FIG. 2B is a perspective view illustrating the composition in which a bobbin 16, an armature 24, and the electromagnet 32R are assembled. FIG. 3A is a perspective view illustrating the composition in which a card 14, the bobbin 16, the armature 24, the electromagnet 32R and contact members (i.e., a movable contact member 18 and fixed contact members 20 and 22) are assembled. FIG. 3B is a perspective view illustrating the electromagnetic relay 100.

As illustrated in FIG. 1, the electromagnetic relay 100 includes a cover 10, a housing 12, the card 14, the bobbin 16, the contact members, the armature 24, and the electromagnet 32R.

As illustrated in FIGS. 2A and 2B, the electromagnet 32R includes the bobbin 16, a coil 26 and an iron core 28. The coil 26 is wound on an area 16*a* of the bobbin 16. An air hole 16*b* is formed inside the area 16*a*. The iron core 28 is inserted into the air hole 16*b*. As described later, an end face 28*a* of the iron core 28 serves as an attractive surface of the electromagnet 32R. A groove 28*b* going across the end face 28*a* is provided on the end face 28*a*. It is assumed that one area in the end face 28*a* divided by the groove 28*b* is a first area 28*c*, and another area by the end face 28*a* is a second area 28*d*. As illustrated by a dashed line of FIG. 2A, the iron core 28 also penetrates a hole 30*a* of a shading coil 30. The shading coil 30 is fitted into the groove 28*b* so as to surround the first area 28*c*, for example. The caulking processing is applied to the first area 28*c*, so that the shading coil 30 is fixed to the iron core 28, as described below. A terminal 16*c* of the bobbin 16 is electrically connected to the coil 26. The armature 24 is provided in opposition to the end face 28*a*. The bobbin 16 is inserted into an air hole 12*a* of the housing 12.

As illustrated in FIGS. 1 and 3A, the movable contact member 18 includes terminals 18*a*, and a movable contact 18*b* electrically connected to the terminals 18*a*. The fixed contact member 20 (22) includes a terminal 20*a* (22*a*), and a fixed contact 20*b* (22*b*) electrically connected to the terminal 20*a* (22*a*). Each of the terminals 18*a*, 20*a* and 22*a* is a terminal for performing electric connection between the electromagnetic relay 100 and an external device. As illustrated in FIG. 3A, the contact members are mounted on the housing 12 so as to be located at a side opposite to the end face 28*a* via the bobbin 16. From a position near the bobbin 16, the fixed contact member 20, the movable contact member 18 and the fixed contact member 22 are arranged in turn. The card 14 is disposed on the housing 12, and is coupled with the armature 24. As illustrated in FIG. 3B, the cover 10 is provided so as to cover the housing 12 through the card 14.

When a voltage is not applied to the coil 26, the electromagnet 32R does not generate a magnetic force. Therefore, the armature 24 is not attracted to the end face 28*a*, and separates from the end face 28*a*. The movable contact member 18 is a member including a plate spring, for example, and causes a force in a Z1 direction to the movable contact 18*b*. Therefore, the movable contact 18*b* contacts the fixed contact 20*b*, and separates from a fixed contact 22*b*. When a voltage is applied to the coil 26 via the terminal 16*c*, the electromagnet 32R generates the magnetic force. The armature 24 moves in a Z2 direction, and is attracted to the end face 28*a* (see FIG. 2B). The armature 24 presses the card 14 in the Z2 direction, and the card 14 presses the movable contact member 18 in the Z2 direction (see FIG. 3A). That is, the card 14 transfers a press force of the armature 24 to the movable contact member 18. The movable contact 18*b* moves in the Z2 direction, separates from the fixed contact 20*b*, and contacts the fixed contact 22*b*. Thereby, the electromagnetic relay 100 can be switched.

Figure 4A:
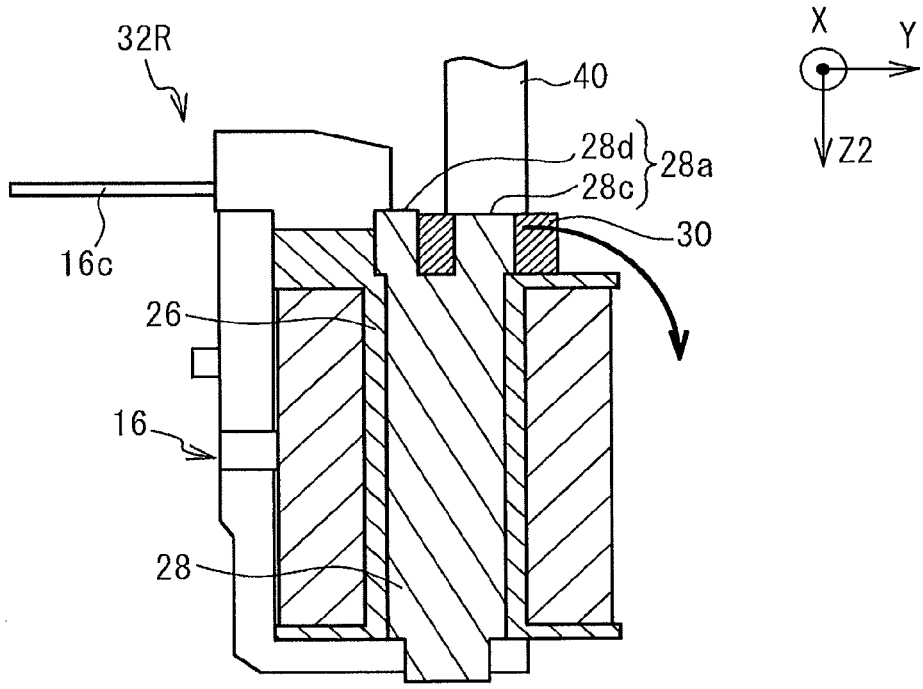
FIG. 4A is a cross-section view illustrating caulking processing.
Figure 4B:
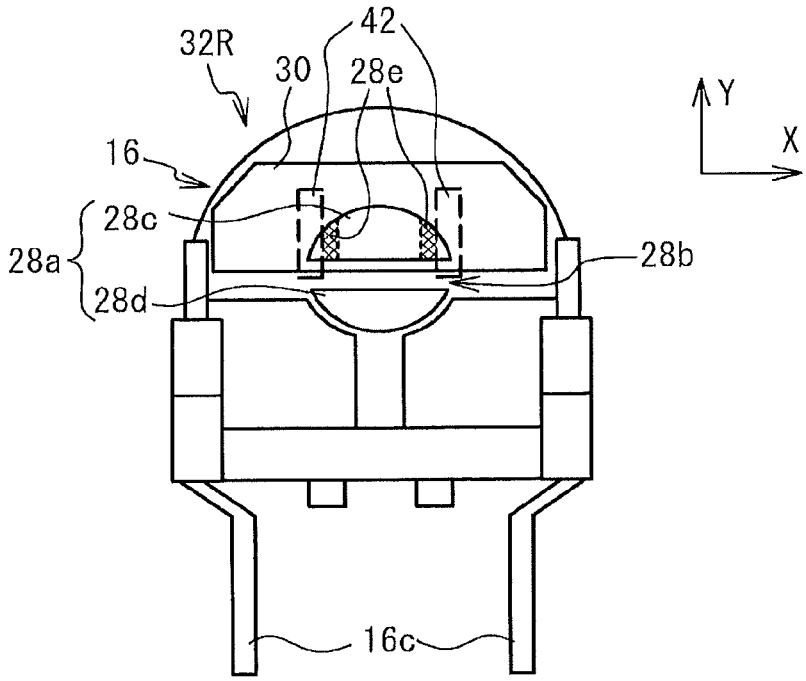
FIG. 4B is a top view illustrating the electromagnet.

The curvature and the distortion which occur in the iron core 28 are explained. FIG. 4A is a cross-section view illustrating the caulking processing, and FIG. 4B is a top view illustrating the electromagnet 32R. Here, a direction in which the groove 28*b* goes across the end face 28*a* is set as an X-direction, and a direction perpendicular to the X-direction in the end face 28*a* is set as a Y-direction.

As illustrated in FIG. 4A, a caulking punch 40 disposed on the iron core 28 descends in the Z2 direction. The caulking punch 40 presses the first area 28*c* and the shading coil 30 to perform the caulking processing. As illustrated by a dashed rectangles in FIG. 4B, caulking areas 42 are formed on both ends of the first area 28*c* and the shading coil 30. Each of the caulking areas 42 is an area where the caulking processing has been performed. In the caulking areas 42, the end face 28*a* and the shading coil 30 are pressed. Thus, the shading coil 30 is fixed to the iron core 28. The caulking areas 42 are not formed on the second area 28*d*. That is, the caulking processing is not applied to the second area 28*d*.

The press force of the caulking punch 40 is unevenly applied to the first area 28*c*. Therefore, as illustrated by an arrow of FIG. 4A, the first area 28*c* of the iron core 28 curves in the Y-direction. In addition, as illustrated by a lattice hatching of FIG. 4B, distortion 28*e* (deviation of thickness) occurs in the first area 28*c*. The distortion 28*e* is roughness of the first area 28*c*. The distortion 28*e* is easily generated in areas which adjoin the caulking areas 42, for example. The magnetic force of the electromagnet 32R varies by the curvature and the distortion 28*e*. As a result, the beat is not restrained, and the function of the electromagnetic relay 100 is spoiled. Next, a description will be given of embodiments of the present invention with reference to the drawings.

First Embodiment

Figure 5A:
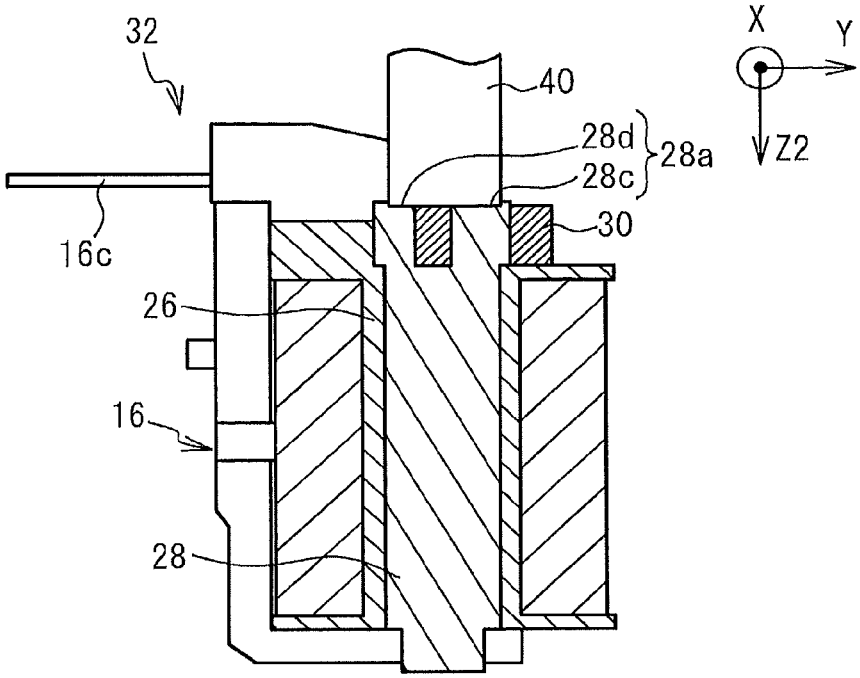
FIG. 5A is a cross-section view illustrating the caulking processing according to a first embodiment.
Figure 5B:
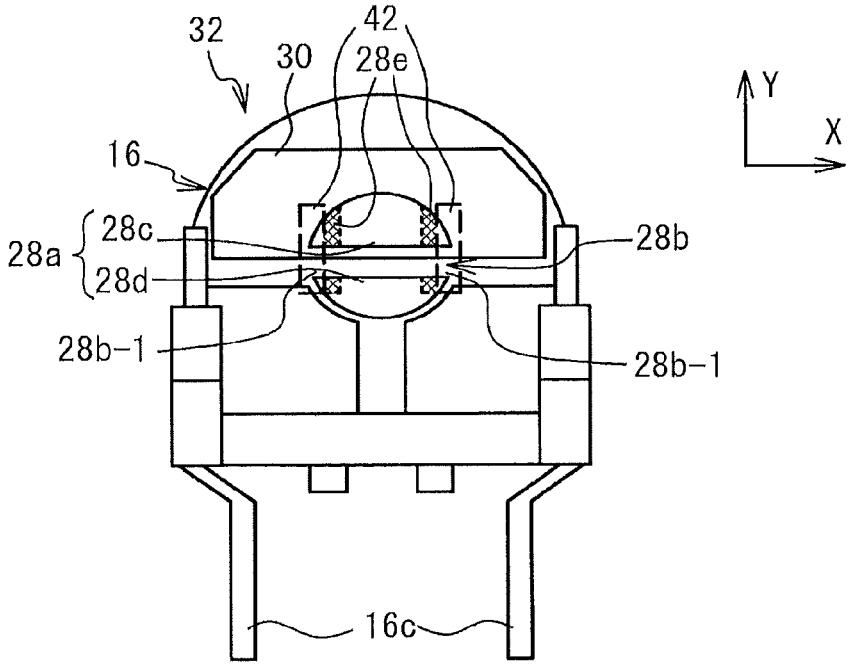
FIG. 5B is a top view illustrating the electromagnet.

A first embodiment indicates an example in which the caulking processing is applied to the first area 28*c* and the second area 28*d*. The composition of the electromagnetic relay is the same as that of the above-mentioned electromagnetic relay except for an electromagnet 32. FIG. 5A is a cross-section view illustrating the caulking processing according to a first embodiment. FIG. 5B is a top view illustrating the electromagnet 32.

As illustrated in FIG. 5A, the caulking processing is applied to two areas (i.e., the first area 28*c* and the second area 28*d*) sandwiching the groove 28*b*. As a result, the caulking areas 42 are formed on both of the first area 28*c* and the second area 28*d*, as illustrated in FIG. 5B. Thereby, the shading coil 30 is fixed to the iron core 28.

The caulking punch 40 presses both of the first area 28*c* and the second area 28*d*. Thereby, the press force of the caulking punch 40 is hard to be biased, and is almost evenly added to both of the first area 28*c* and the second area 28*d*. Therefore, the curvature of the iron core 28 is restrained. Thereby, the beat can be restrained.

In order to apply the caulking processing to the first area 28*c* and the second area 28*d*, the caulking punch 40 may have a width which straddles the groove 28*b* and overlaps with the first area 28*c* and the second area 28*d*. The caulking punch 40 may be shifted from the position of the comparative example, and may be arranged at a position which overlaps with the first area 28*c* and the second area 28*d*. For example, a part of the first area 28*c* included in each of the caulking areas 42 may have a size different from a part of the second area 28*d* included in each of the caulking areas 42. Moreover, the part of the first area 28*c* included in each of the caulking areas 42 may have the same size as the part of the second area 28*d* included in each of the caulking areas 42. Thereby, the press force to be added to the first area 28*c* is substantially equal to the press force to be added to the second area 28*d*, and hence the curvature is restrained. It is desirable that the caulking areas 42 are located at both ends 28*b*-1 of the groove 28*b*. That is, it is desirable that the caulking processing is applied to the first area 28*c* and the second area 28*d* in positions which sandwich the both ends 28*b*-1 of the groove 28*b*. Thereby, the press force is added evenly and the curvature is restrained effectively. When a plurality of grooves are provided on the end face 28*a* and the end face 28*a* is divided into three or more areas, the caulking punch 40 may apply the caulking processing to the areas sandwiching the grooves.

Second Embodiment

Figure 6A:
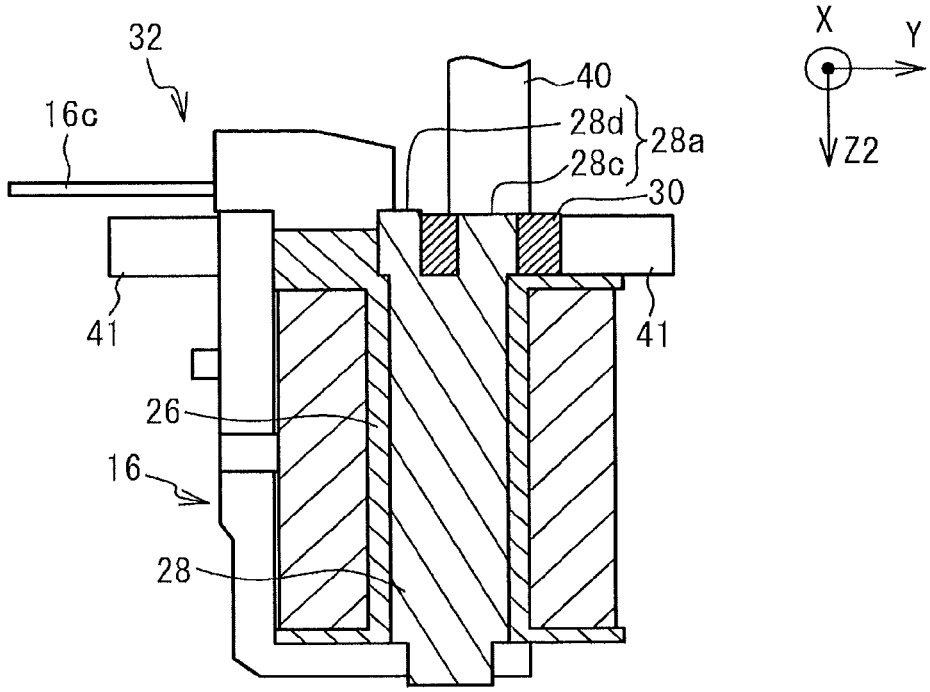
FIG. 6A is a cross-section view illustrating the caulking processing according to a second embodiment.

A second embodiment indicates an example in which the caulking processing is performed while the iron core 28 is being supported. FIG. 6A is a cross-section view illustrating the caulking processing according to a second embodiment, FIG. 6B is a top view illustrating the electromagnet 32.

Figure 6B:
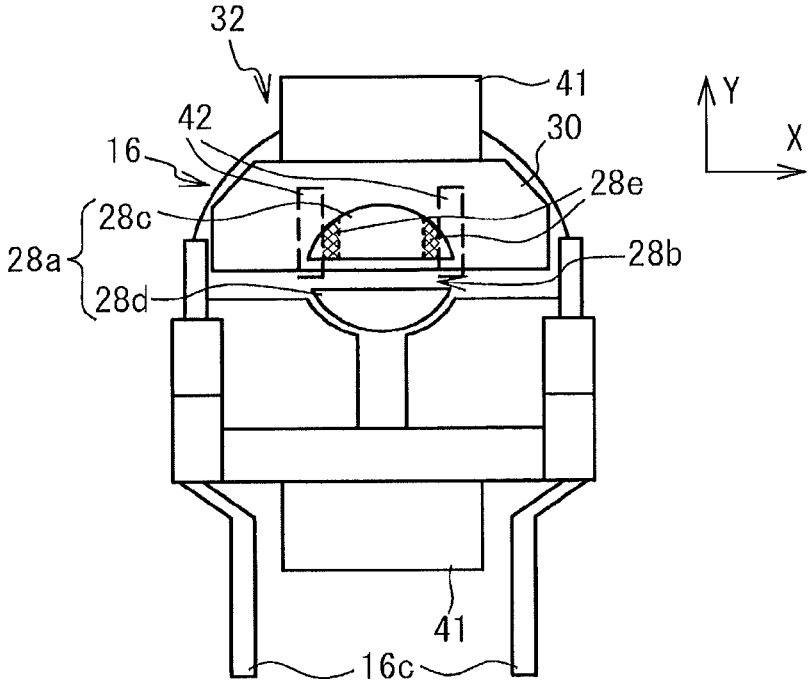
FIG. 6B is a top view illustrating the electromagnet.

As illustrated in FIGS. 6A and 6B, a supporting unit 41 sandwiches the iron core 28 and the shading coil 30 in the Y-direction. The caulking processing is performed in a state where the supporting unit 41 supports the side surfaces of the iron core 28 in the Y-direction. Thereby, the curvature can be restrained.

The supporting unit 41 may support the side surface of the iron core 28 in a radial direction of the end face 28*a* (i.e., a direction toward the center of the iron core 28 from the outside of the iron core 28). As illustrated in FIG. 4A, a curvature occurs in the Y-direction easily. Therefore, the supporting unit 41 supports the iron core 28 in the Y-direction, so that the curvature can be restrained effectively. The supporting unit 41 may support the side surface of the iron core 28 in a direction crossing the X-direction other than the Y-direction, and may support the side surface of the iron core 28 so as to surround the end face 28*a*, for example. The supporting unit 41 is provided on a jig for fixing the bobbin 16, for example.

Third Embodiment

Figure 7A:
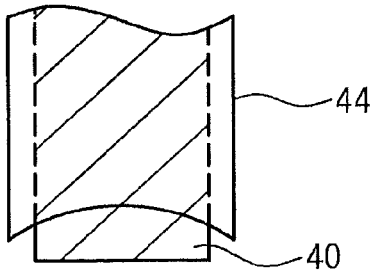
FIG. 7A is a cross-section view illustrating a caulking punch and a supporting unit.
Figure 7B:
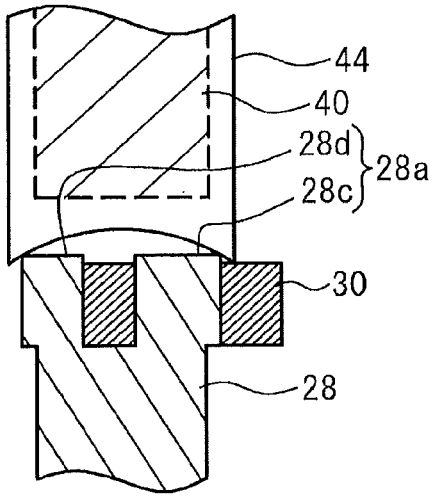
FIGS. 7B and 7C are cross-section views illustrating the caulking processing.
Figure 7C:
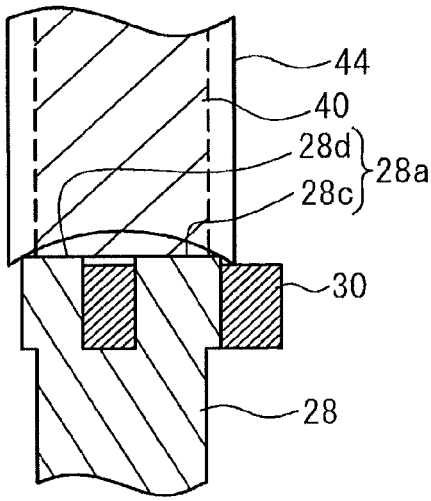

A third embodiment indicates another example in which the caulking processing is performed while the iron core 28 is being supported. FIG. 7A is a cross-section view illustrating the caulking punch 40 and a supporting unit 44. FIGS. 7B and 7C are cross-section views illustrating the caulking processing. The bobbin 16 is omitted. Oblique lines are added to the caulking punch 40.

As illustrated in FIG. 7A, the supporting unit 44 is provided so as to surround the caulking punch 40. The caulking punch 40 can descend and rise independently of the supporting unit 44. The supporting unit 44 has a shape like a dome which covers the end face 28*a*, for example. Next, the caulking processing is explained.

As illustrated in FIG. 7B, the supporting unit 44 descends ahead of the caulking punch 40, and contacts the edge of the end face 28*a*. Thereby, the supporting unit 44 supports the edge of the end face 28*a* in the radial direction of the end face 28*a*. At this time, the caulking punch 40 does not contact the end face 28*a*. As illustrated in FIG. 7C, the caulking punch 40 performs the caulking processing. That is, the caulking processing is performed in a state where the supporting unit 44 supports the edge of the end face 28*a*. Therefore, the curvature of the iron core 28 is restrained.

It is desirable that, in order to restrain the curvature effectively, the supporting unit 44 contacts the iron core 28 before the caulking punch 40 contacts the iron core 28. The supporting unit 44 completely surrounds the end face 28*a* in the radial direction of the end face 28*a*. Therefore, the curvature in all directions can be restrained. Here, the supporting unit 44 does not need to completely surround the end face 28*a*, and may surround a part of the end face 28*a*, for example. Especially, it is desirable that the supporting unit 44 supports the end face 28*a* in the Y-direction. This is because the curvature to be easily generated in the Y-direction can be restrained. The shape of the supporting unit 44 may be a shape other than the dome shape, and the supporting unit 44 needs to have an area which contacts the edge of the end face 28*a* and the side surface of the iron core 28.

The second and the third embodiments may be combined with the first embodiment. That is, the caulking processing may be applied to both of the first area 28*c* and the second area 28*d* while the iron core 28 is being supported in the radial direction of the end face 28*a*. Thereby, the curvature can be restrained effectively.

Fourth Embodiment

Figure 8A:
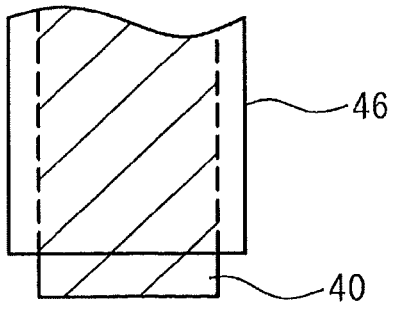
FIG. 8A is a cross-section view illustrating the caulking punch and a flattening unit.
Figure 8B:
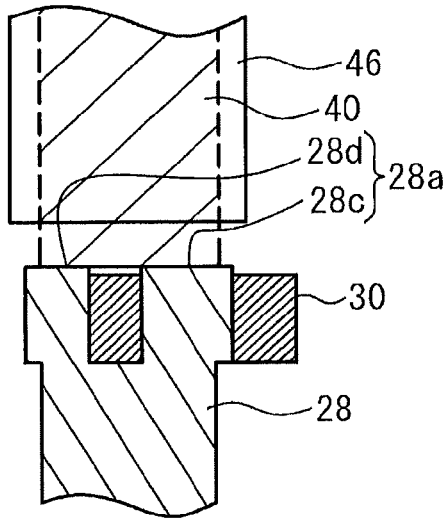
FIG. 8B is a cross-section view illustrating flattening processing.
Figure 8C:
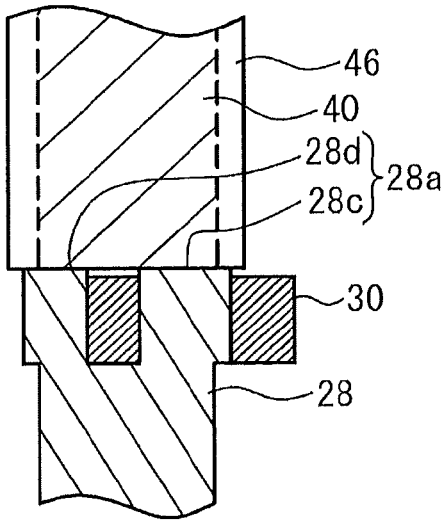
FIG. 8C is a cross-section view illustrating the caulking processing.

A fourth embodiment indicates an example in which flattening processing is performed. FIG. 8A is a cross-section view illustrating the caulking punch 40 and a flattening unit 46. FIG. 8B is a cross-section view illustrating the flattening processing. FIG. 8C is a cross-section view illustrating the caulking processing. The bobbin 16 is omitted.

As illustrated in FIG. 8A, the caulking punch 40 is located inside the flattening unit 46. The caulking punch 40 can descend and rise independently of the flattening unit 46. Next, the caulking processing and the flattening processing are explained.

As illustrated in FIG. 8B, the caulking punch 40 descends ahead of the flattening unit 46, and performs the caulking processing. As illustrated in FIG. 8C, after the caulking processing, the flattening unit 46 descends and presses the end face 28*a*. Thereby, the flattening processing is performed, and the end face 28*a* becomes flat.

Figure 9A:
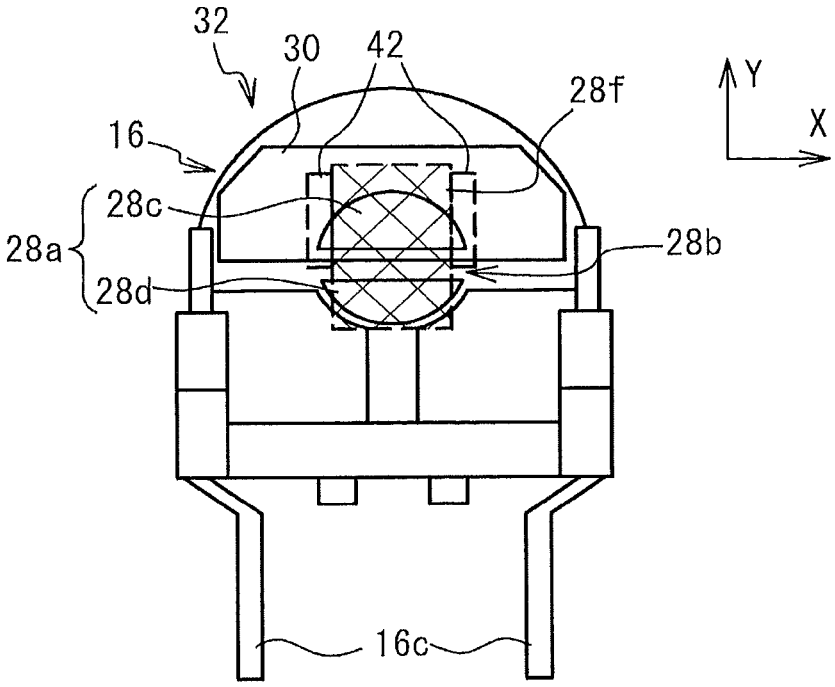
FIG. 9A is a top view illustrating the electromagnet after the flattening processing and the caulking processing.

FIG. 9A is a top view illustrating the electromagnet 32 after the flattening processing and the caulking processing. As illustrated in FIG. 9A, the distortion 28*e* (see FIG. 4B) is removed by the flattening processing, and a flattening area 28*f* is formed on the end face 28*a*. The flattening area 28*f* is flatter than the distortion 28*e*. Therefore, the beat can be restrained effectively.

To remove the distortion, the flattening unit 46 flattens at least a part of an area other than the caulking areas 42 in the end face 28*a*. Especially, it is desirable that the flattening unit 46 flattens an area which adjoins the caulking areas 42. This is because the distortion 28*e* is easily generated in the area which adjoins the caulking areas 42. In addition, the flattening unit 46 may flatten the whole area other than the caulking areas 42. Thereby, the flattening of the end face 28*a* can be improved more.

Figure 9B:
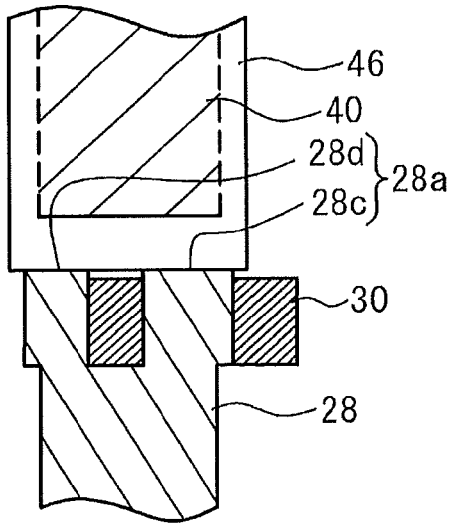
FIG. 9B is a cross-section view illustrating another example of the flattening processing and the caulking processing.

FIG. 9B is a cross-section view illustrating another example of the flattening processing and the caulking processing. As illustrated in FIG. 9B, the flattening unit 46 contacts the end face 28*a* before the caulking punch 40 contacts the end face 28*a*, and then the flattening processing may be performed in a state where the flattening unit 46 presses the end face 28*a*. That is, the caulking processing and the flattening processing may be performed at the same time. Thereby, the generation of the distortion can be restrained.

The first to the third embodiments may be combined with the fourth embodiment. Thereby, the curvature can be restrained and the distortion can be removed. Therefore, the beat can be restrained effectively.

Fifth Embodiment

Figure 10A:
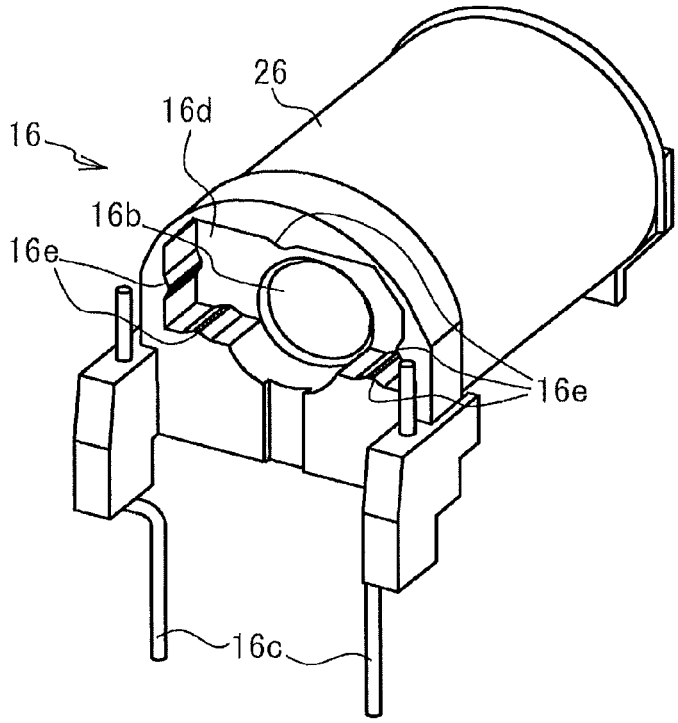
FIG. 10A is a perspective view illustrating the bobbin of the electromagnetic relay according to a fifth embodiment.
Figure 10B:
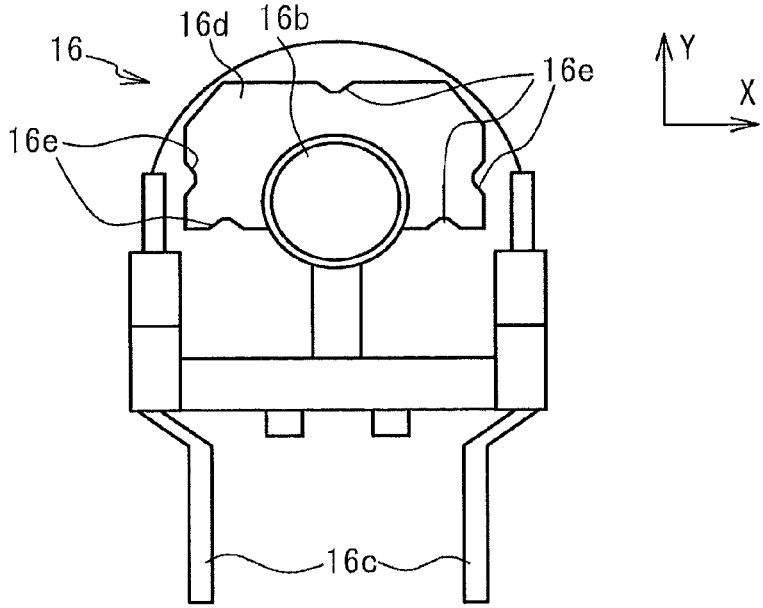
FIG. 10B is a front view illustrating the bobbin.
Figure 11A:
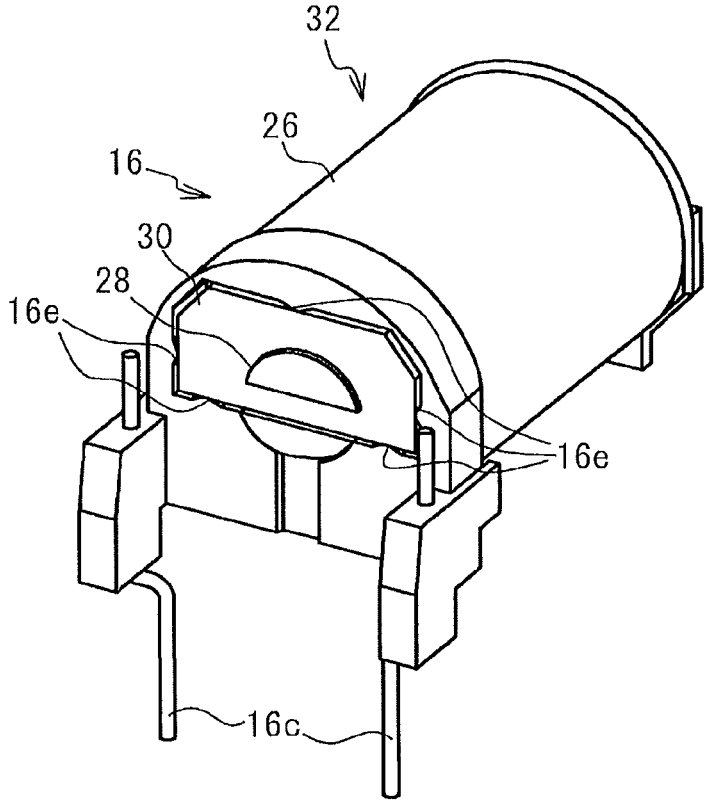
FIG. 11A is a perspective view illustrating the electromagnet.
Figure 11B:
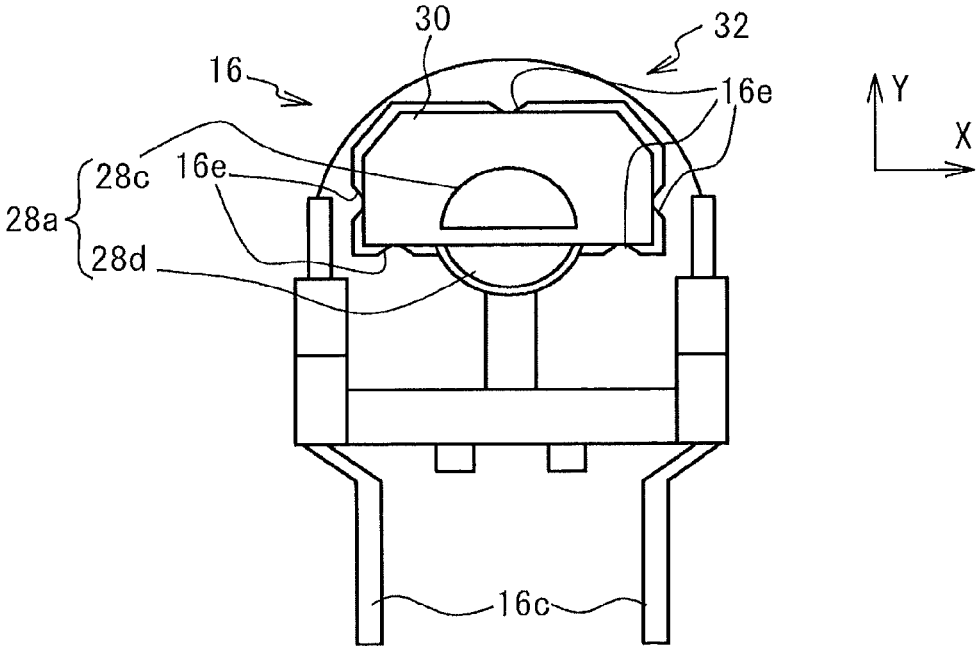
FIG. 11B is a front view illustrating the electromagnet.

A fifth embodiment indicates that an example in which the shading coil 30 is fixed to the iron core 28 by pushing on an outer circumferential surface of the shading coil 30. FIG. 10A is a perspective view illustrating the bobbin 16 of the electromagnetic relay according to the fifth embodiment. FIG. 10B is a front view illustrating the bobbin 16. The iron core 28 and the shading coil 30 are not provided on the bobbin 16. FIG. 11A is a perspective view illustrating the electromagnet 32. FIG. 11B is a front view illustrating the electromagnet 32.

As illustrated in FIGS. 10A to 11B, an air hole 16*d* (i.e., a storage unit) is formed in the bobbin 16. Five projections 16*e* (i.e., a holding unit) are formed in an inner wall of the bobbin 16 surrounding the air hole 16*d*. The projections 16*e* are projected to the inside of the air hole 16*d* from the inner wall.

As illustrated in FIGS. 11A and 11B, the iron core 28 is inserted into the bobbin 16, and the shading coil 30 is fitted on the iron core 28. The shading coil 30 is located in the air hole 16*d*. The projections 16*e* are projected toward the shading coil 30, and hold the outer circumferential surface of the shading coil 30. Thereby, the shading coil 30 is fixed to the iron core 28. According to the fifth embodiment, the caulking processing is not required. Therefore, the curvature and the distortion caused by the caulking processing can be restrained.

It is desirable that the projections 16*e* hold the shading coil 30 in order to fix the shading coil 30 solidly. It is also desirable that the projections 16*e* hold the shading coil 30 from a plurality of directions. In the fifth embodiment, since the projections 16*e* hold the shading coil 30 from the X-direction and the Y-direction, the shading coil 30 can be fixed solidly. Thus, it is desirable that the projections 16*e* hold the shading coil 30 from a plurality of directions. The projections 16*e* may hold the shading coil 30 from any one of the X-direction and the Y-direction. Alternatively, the projections 16*e* may hold the shading coil 30 from a direction other than the X-direction and the Y-direction. Although the number of projections 16*e* is five, the number of projections 16*e* may be equal to or less than four, or equal to or more than six.

Also in the fifth embodiment, the caulking processing may be performed as with the first to the fourth embodiments, for example. Thereby, the shading coil 30 is fixed more solidly.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. An electromagnetic relay comprising:

an iron core that has an end face and a groove formed in the end face;

a shading coil having a portion of which is fitted in the groove;

a bobbin including an opening defined by a plurality of walls that receives the shading coil therein;

a plurality of spaced projections extending inwardly from the walls of the bobbin, wherein said plurality of spaced projections contact an outer surface of the shading coil therebetween and hold the shading coil in the opening.

2. The relay recited in claim 1, wherein the plurality of projections is five projections.

3. The relay recited in claim 1, wherein the periphery of the shading coil includes a flat top, a flat bottom and two flat side portions and the plurality of projections respectively contact the top, bottom, and side portions of the shading coil.

4. The rely recited in claim 3, wherein one projection contacts the top, one projection contacts each of the two side portions and two projections contact the bottom.

* * * * *

UNITED STATES PATENT AND TRADEMARK OFFICE

CERTIFICATE OF CORRECTION

PATENT NO. : 8,902,029 B2
APPLICATION NO. : 14/067571
DATED : December 2, 2014
INVENTOR(S) : Koyuru Kobayashi et al.

It is certified that error appears in the above-identified patent and that said Letters Patent is hereby corrected as shown below:

In the Claims

Column 8, line 23, in claim 4, delete “rely” and insert -- relay --, therefor.

Signed and Sealed this
Fifth Day of May, 2015

Michelle K. Lee

Michelle K. Lee
*Director of the United States Patent and Trademark Office*